United States Patent [19]

Mildern

[11] 3,982,674

[45] Sept. 28, 1976

[54] VALVE

[76] Inventor: William D. Mildern, 11799 N.W. 26 St., Coral Springs, Fla. 33065

[22] Filed: Sept. 9, 1974

[21] Appl. No.: 504,200

Related U.S. Application Data

[63] Continuation-in-part of Ser. No. 420,229, Nov. 29, 1973, Pat. No. 3,841,602.

[52] U.S. Cl. ..... 222/402.21; 222/402.24; 141/20

[51] Int. Cl.[2] ..... B65D 83/14

[58] Field of Search ..... 222/402.2–402.24; 251/344, 353, 354; 141/3, 20

[56] References Cited

UNITED STATES PATENTS

| | | | |
|---|---|---|---|
| 2,757,826 | 8/1956 | Thomas | 222/402.24 X |
| 3,176,887 | 4/1965 | Potapenko et al. | 222/402.2 |
| 3,180,535 | 4/1965 | Ward | 222/402.2 X |
| 3,495,744 | 2/1970 | Webster | 222/402.24 |
| 3,642,180 | 2/1972 | Lehmann | 222/402.23 |
| 3,825,159 | 7/1974 | Laauwe | 222/402.24 |

*Primary Examiner*—Robert B. Reeves
*Assistant Examiner*—Charles A. Marmor
*Attorney, Agent, or Firm*—Oltman and Flynn

[57] ABSTRACT

A valve for a pressurized aerosol dispenser comprises an axially movable, tubular valve body, a piston attached to the valve body, and an annular elastomeric gasket which encompasses the valve body and overlies the piston to provide an annular chamber therebetween when the valve is open. The valve body includes a cylindrical bore through it blocked by a wall which separates the bore into an education passageway and a discharge passageway. Vertically spaced, inlet and outlet orifices communicate with the education and discharge passageways, respectively, with the inlet orifice located above the outlet orifice. The chamber communicates the orifices with each other when the valve is open. The inner margin of the gasket normally sealingly occludes both orifices to close the valve. The vertical spacing between the orifices provides occlusion of the inlet orifice before the outlet orifice as the valve moves toward closure. Only some parts of the orifices need be vertically spaced.

10 Claims, 11 Drawing Figures

FIG.1
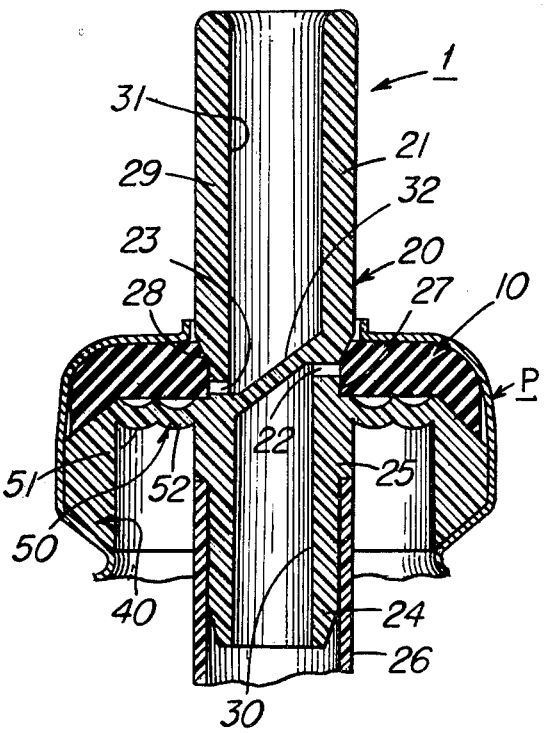
FIG.2
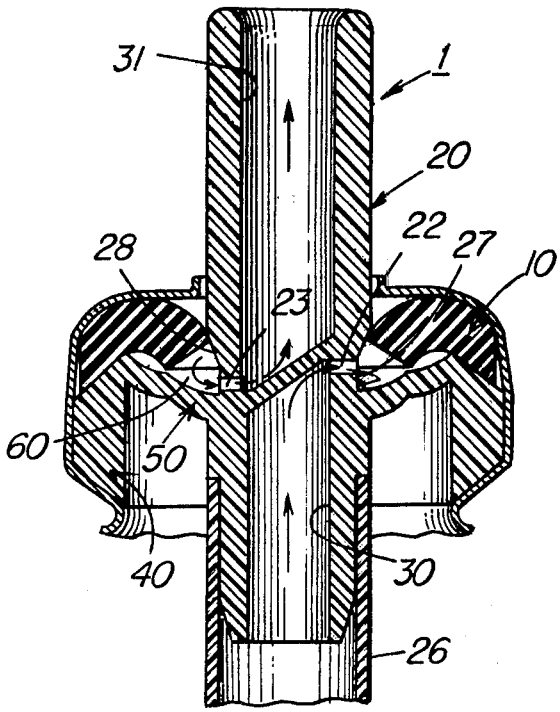
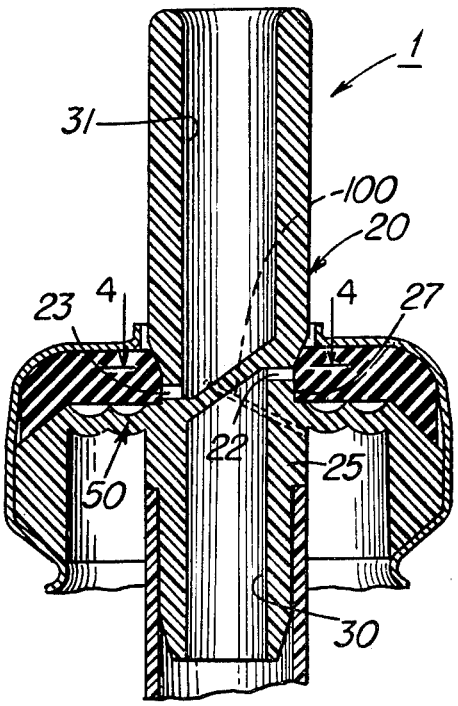
FIG.3
FIG.4
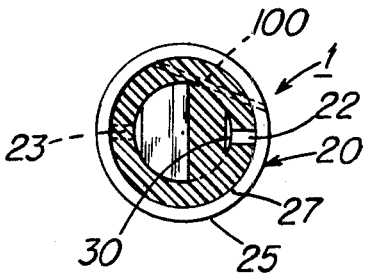

VALVE

RELATED APPLICATION

The application is a continuation-in-part of my copending application Ser. No. 420,229 filed Nov. 29, 1973, now U.S. Pat. No. 3,841,602.

BACKGROUND OF THE INVENTION

The present invention relates to a valve for controlling the flow of a fluid product from a pressurized aerosol dispensing container.

Heretofore, sealing gaskets in valves of this character have been exposed to contact with the product during storage, thereby restricting product formulations to prevent gasket deterioration and leakage or necessitating special gasketing materials. Also, failure of the gasket to properly seal the outlet orifice of a valve of this character caused leakage through the valve since a back-up, or reserve, shut-off had not been conveniently providable. Failure to accomplish complete sealing occlusion of the orifice of prior valves has also been a problem with powdered or suspended particle products. In addition, spring-biased valves require significant force to keep the valve open, thereby undesirably fatiguing the operator when the valve is held open for relatively long periods of time, such as in spraying paint.

SUMMARY OF THE INVENTION

The valve of the present invention is adapted for use with a pressurized aerosol dispensing container and comprises an axially movable, tubular valve body; a piston attached to the valve body; and an annular elastomeric sealing gasket encompassing the valve body and overlying the piston to provide an annular chamber there-between when the valve is open. The valve body includes a cylindrical bore through it with a wall blocking the bore and separating the bore into an eduction passageway and an outlet orifice in communication with the discharge passageway. The chamber communicates the inlet orifice with the outlet orifice when the valve is open. The inlet and outlet orifices are vertically spaced from each other with the inlet orifice above the outlet orifice. The inner margin of the gasket normally sealingly occludes both of the orifices to close the valve. As the valve moves toward closure, the vertical spacing between the inlet and outlet orifices provides occlusion of the inlet orifice before the outlet orifice. Only some parts of the orifices need be vertically spaced.

It is an object of the present invention to provide a valve with a dual shut-off so that, if the gasket fails to completely occlude one orifice, the occlusion of another orifice will provide an adequate seal to prevent loss of product or propellant.

It is also an object to isolate the gasket from exposure to the product when the valve is closed in order to prevent degradation of the gasket.

It is a further object to provide a valve which can be held open for long periods of time without undue fatigue.

These, and other desired objects which appear in the description of the present invention, are provided by the valve of the present invention.

BRIEF DESCRIPTION OF THE DRAWINGS

FIG. 1 is a side elevation view, in vertical section, of the valve of my U.S. Pat. No. 3,841,602 in its closed condition.

FIG. 2 is a side elevation view, in vertical section, of the valve 1 of FIG. 1 in its open condition.

FIG. 3 is a side elevation view, in vertical section, of an alternative embodiment of the valve 1 of FIG. 1.

FIG. 4 is a top plan view, in horizontal section taken along the line 4—4 in FIG. 3, of the valve body 20 of FIG. 3.

Figure 5:
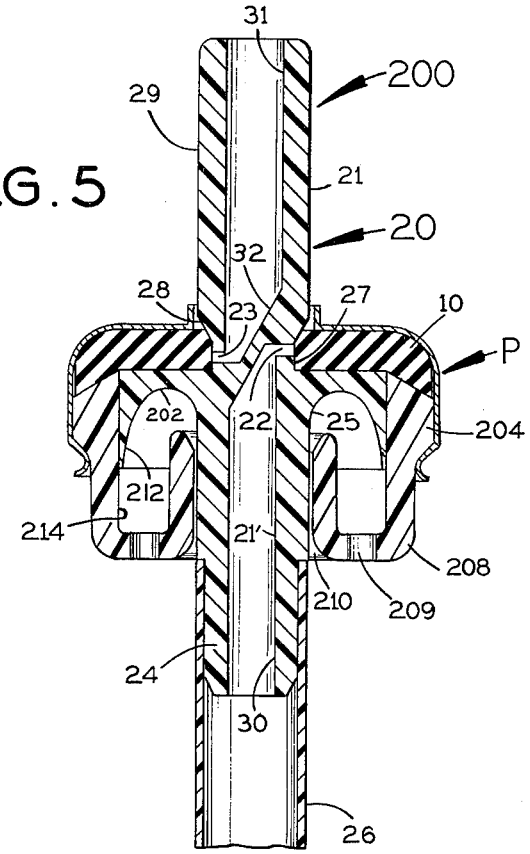
FIG. 5 is a side elevation view, in vertical section, of a first embodiment of the valve of the present invention which in some respects represents an improvement over the valve of FIGS. 1–4.

The valve 1 illustrated in FIG. 1, in accordance with my U.S. Pat. No. 3,841,602 comprises an elastomeric sealing gasket 10 and a tubular valve body 20 with an integrally associated mounting ring 40 and diaphragm 50. The valve body 20 has an upstanding tubular valve stem 21 with vertically spaced, transverse inlet and outlet orifices 22 and 23, respectively, which operate sequentially so that on closing, the inlet orifice 22 is closed while the outlet orifice 23 remains open, thereby purging the valve 1 of dispensed product. The valve 1 also provides an annular chamber 60 (FIG. 2) interconnecting the orifices 22 and 23 which collapses radially inwardly as the valve 1 closes so that dispensed product in the chamber 60 is squeezed out of the chamber 60 through the outlet orifice 23. This removes residual product from contact with the gasket 10. The diaphragm 50 further isolates the gasket 10 from contact with product in the container during storage. This squeezing and isolation by the diaphragm 50, in conjunction with the aforesaid purging, protects the gasket 10 from deterioration from extended exposure to the dispensed product. In addition, the inlet and outlet orifices 22 and 23, respectively, provide a dual shut-off capability in the valve 1 so that if one orifice should fail to be sealed, the second orifice will still be sealed and prevent product leakage.

The valve 1 is usually crimped in a centrally apertured, upstanding pedestal portion P of a conventional valve mounting cup which is secured to the mouth of a pressurized aerosol dispenser. The valve is used to selectively discharge a pressurized product which is usually a fluid or a powder.

The valve body 20 has a generally tubular and cylindrical configuration and comprises an upstanding tubular valve stem 21, a depending tubular eduction nipple 24 and a tubular base 25 between the valve stem 21 and eduction tube nipple 24. An eduction tube 26 may be slipped over the eduction nipple 24 to draw fluid from the bottom of the container. The valve stem 21 rises axially upwardly from the base 25 and includes a reduced diameter, cylindrical neck 27 through which the transverse inlet and outlet orifices 22 and 23, respectively, pass; an upwardly and outwardly tapered, frusto-conical shoulder 28; and an outwardly extending hollow cylindrical tip 29 on top. A cylindrical bore extends axially through the valve body 20 with a septum or wall 32 blocking the bore and separating it into an axial eduction passageway 30 and an axial discharge passageway 31 which are coaxially aligned with each other. The eduction passageway 30 extends upwardly through the eduction tube nipple 24 and into the intermediate base 25 below the wall 32 to communicate with the inlet orifice 22. The discharge passageway 31 extends downwardly through the valve stem 21 into the intermediate base 25 above the wall 32 to communicate with the outlet orifice 23. The eduction and discharge passageways 30 and 31, respectively, conduct fluid or powder product through the valve 1. The integral wall 32 blocks both the upper end of the eduction passageway 30 and the lower end of the discharge passageway 31 and prevents direct communication between the two passageways, 30 and 31.

In addition to the valve body 20, the valve 1 includes the annular mounting ring 40 with resilient diaphragm 50 integrally connecting it to the base 25 of the valve body 20. The integral ring 40 is spaced circumferentially from the valve body 20 so that the valve body 20 is free to move axially vertically by flexure of the diaphragm 50. The bottom of the ring 40 extends angularly outwardly and upwardly so that the crimping of the mounting cup pedestal P adjacent the bottom of the ring 40 wedges the ring 40 upwardly and clamps the outer margin of gasket 10 into sealing engagement between the ring 40 and the mounting cup pedestal P. The top of the ring 40 extends angularly outwardly and downwardly so that this clamping is between the top wall of the mounting pedestal P and the upper edge and top of the ring 40.

The diaphragm 50 extends generally radially from the upper edge of the valve body base 25 to the inner wall of the ring 40. Since it is imperforate, the diaphragm 50 isolates the gasket 10 from the contents of the container. For this reason it also acts as a piston to keep the valve 1 closed because its lower surface is exposed to container pressure and its upper surface is exposed to a lower pressure. Consequently, container pressure forces the diaphragm 50 upwardly against the gasket 10, thereby biasing its integral valve body 20 upwardly into its closed position. Since the valve 1 is actuated by axially depressing the valve body 20, the resilient diaphragm is capable of flexing downwardly. The provision of radially spaced, circumferential corrugations 51 and 52 further facilitates flexion.

The elastomeric sealing gasket 10 has a centrally apertured, annular configuration so that when it is clamped in a transverse orientation by the upper edge of ring 40 its inner margin encompasses and grips the neck 27 and a portion of shoulder 28. The inner margin seals the inlet and outlet orifices 22 and 23, respectively.

In the form of valve illustrated in FIG. 1, a sequential sealing of the inlet and outlet is effected by vertically spacing the inlet and outlet orifices 22 and 23, respectively, so that the gasket 10 blocks the inlet orifice 22 before it blocks the outlet orifice 23. Accordingly, the two orifices 22 and 23 are spaced with the inlet orifice 22 above (at the intersection of the neck 27 with the frusto-conical shoulder 28) and with the outlet orifice 23 below (at the intersection of the neck 27 with the base 25 in close proximity with the juncture of the diaphragm 50 with the base 25.) The wall 32 is inclined, or skewed, upwardly so that the lower edge of its top surface is beneath the outlet orifice 23 and the upper edge of its bottom surface is above the inlet orifice 22. As shown, the orifices 22 and 23 lie in a common vertical plane so that they are diametrically opposed to provide maximum circumferential spacing on the neck 17, thereby permitting maximal vertical spacing. The sequential orifice closure afforded by this construction makes the valve self-purging of product.

When the valve 1 is opened (FIG. 2) an annular chamber 60 is formed which communicates inlet orifice 22 with outlet orifice 23. This chamber 60 is defined by the outer surface of the neck 27 and shoulder 28, the lower face and inner marginal surface of the gasket 10, and the upper surface of the diaphragm 50.

If desired, the valve 1 may be modified, such as by providing a transverse vapor tap vent in the base 25 for injecting propellant into the product stream. This propellant injection assists in breaking the product up into a spray.

In another embodiment of the valve according to my U.S. Pat. No. 3,841,602, shown in FIGS. 3 and 4 herein, the valve 1 is provided with a purging orifice 100 which conveys propellant from the container to the outside of the neck 27 between the inlet and outlet orifices 22 and 23, respectively, for purging the chamber 60, the outlet orifice 23 and the discharge passageway 31 with propellant after the inlet orifice 22 is closed. The purging orifice 100 extends angularly upwardly through the material of the valve body 20 from the outside of the base 25 adjacent the diaphragm 50 to the outside of the neck 27 at a point located vertically between the inlet and outlet orifices 22 and 23, respectively. While the purging orifice 100 passes alongside the eduction and discharge passageways 30 and 31, respectively, as it passes through the valve body 20, it does not communicate with them.

The valve 1 is opened by axially depressing the valve body 20. (See FIG. 2). The frusto-conical shoulder 28 flexes the sealing gasket 10 downwardly which deflects the inner margin of the gasket 10 out of contact with the inlet and outlet orifices 22 and 23, respectively. With these two orifices 22 and 23 open and in communication with each other via the annular chamber 60, dispensed product flows axially up through the eduction tube 26 and eduction passageway 30; transversely out through the inlet orifice 22; circumferentially through the chamber 60; transversely in through the outlet orifice 23; and, finally, axially up through the discharge passageway 31 for dispensing. (See flow arrows in FIG. 2). Due to the comparatively large internal volume of the annular chamber 60 and the discharge passageway 31 and in the decreasing ambient pressure within them, pressurized product can act as sequential expansion chambers.

Unlike a spring-operated valve, the force required to keep the valve 1 open is less than the force required to open it, since at least some of the elevated container pressure is present in the chamber 60 when the valve 1 is open and counteracts the upward force of container pressure on the diaphragm 50. When the valve 1 is closed the upward force predominates. Consequently, keeping the valve 1 open for long periods of time, such as when spraying paint or insecticide, is less fatiguing than when using a conventional spring-operated valve.

When downward force on the valve body 20 is released, the force of container pressure on the diaphragm 50 urges the valve body 20 upwardly and the valve 1 starts to close. As the gasket 10 returns upwardly to its original unflexed, or planar, condition, its inner margin blocks off and seals the inlet orifice 22 first, thereby terminating fluid ingress to the valve 1. Contemporaneously, the annular chamber 60 starts to collapse radially inwardly starting at the juncture of the gasket 10 with the ring 40, thereby squeezing residual product in the chamber 60 out of the outlet orifice 23. Pressurized product remaining in the chamber 60 after the inlet orifice 22 closed would explain and would force some product out of the chamber 60, thereby purging the chamber 60, the outlet orifice 23 and the discharge passageway 31. Finally, valve body 20 returns to its uppermost position with the outlet orifice 23 blocked and the chamber 60 collapsed to its greatest extent. Since upward force on the diaphragm 50 from container pressure is greater than the downward force of atmospheric pressure, the valve 1 remains closed with both orifices 22 and 23 blocked and the diaphragm 50 sealing the gasket 10 from the potentially deleterious product in the container interior.

DESCRIPTION OF THE PREFERRED EMBODIMENTS

In FIG. 5, parts like those of FIG. 1 have the same reference numerals. Modified and different parts have different reference numerals.

The valve 200 of FIG. 5 includes a tubular valve body 20 having an upstanding tubular valve stem 21 with vertically spaced inlet and outlet orifices 22 and 23 which operate sequentially so that on closing, the inlet orifice 22 is closed while the outlet orifice remains open, thereby purging the valve 200 of dispensed product. The valve stem 21 and the orifices 22 and 23 are constructed the same, operate the same, and have the same functions as the same elements in the embodiment of FIG. 1.

In FIG. 5, there is a piston 202 which replaces the diaphragm 52 of FIG. 1. The piston 202 may be integral with valve stem 21 or it may be a separate piece affixed to valve stem 21. There is also a mounting ring 204 which is a separate piece. The mounting ring 204 is crimped in a centrally apertured, upstanding pedestal portion P of a conventional valve mounting cup which is secured to the mouth of pressurized aerosol dispenser. The valve 200 is used to selectively discharge a pressurized product which is usually a fluid or a powder associated with a gas propellant.

An elastomeric sealing gasket 10 is mounted within pedestal P on top of mounting ring 204. The piston 202 is normally urged against the sealing gasket 10 by the pressure of the propellant for the product.

The mounting ring 204 has a guide portion 208 which extends downward from pedestal P and then inwardly and upwardly to form a central bore 210 which slidably receives the lower part 21' of the valve stem 21 in which the eduction passage 30 is located. Lower valve stem part 21' receives the dip tube 26. The guide portion 208 of mounting ring 204 has apertures 209 which allow the propellant to enter the space within the guide portion and act on the piston 202.

The lower surface of the piston 202 may be semi-spherical to form a thin circular yieldable skirt 212 which slidably engages the inner cylindrical surface 214 of the mounting ring 204.

Figure 6:
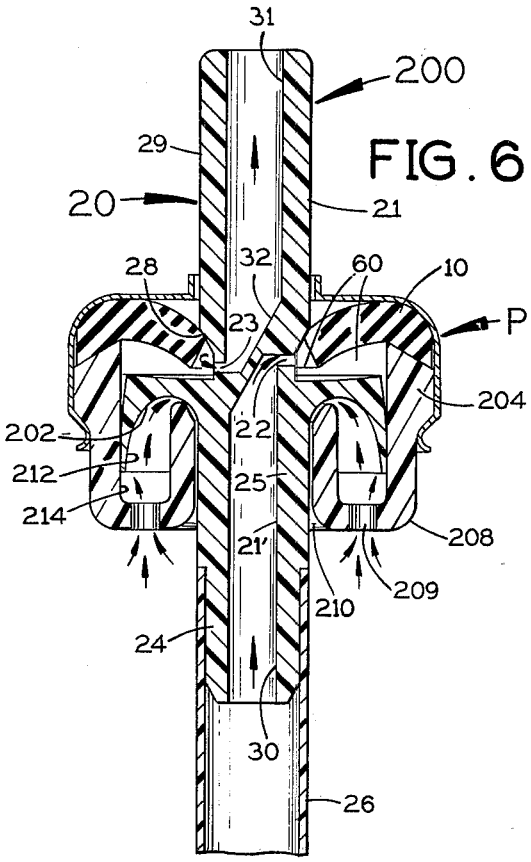
FIG. 6 is a view similar to FIG. 5 and shows the valve of that Figure depressed to discharge product.

The operation of the valve 200 to discharge pressurized product is shown in FIG. 6. When the valve body 20 is depressed, the sealing gasket 10 flexes to form a compartment 60. Product flows through the eduction passage 30, inlet orifice 22, compartment 60, outlet orifice 23 and discharge passage 31. When the valve body 20 is released, sealing gasket 10 provides spring action to return the valve body upward. The inlet orifice 22 is closed by the sealing gasket 10 while the outlet orifice 23 remains open to allow the compartment 60 to be purged of product before the outlet orifice closes. As product is purged from compartment 60, the pressure in it reduces, so there is a differential of pressure across the piston 202 which aids in further returning the valve to its initial condition as shown in FIG. 5.

Figure 7:
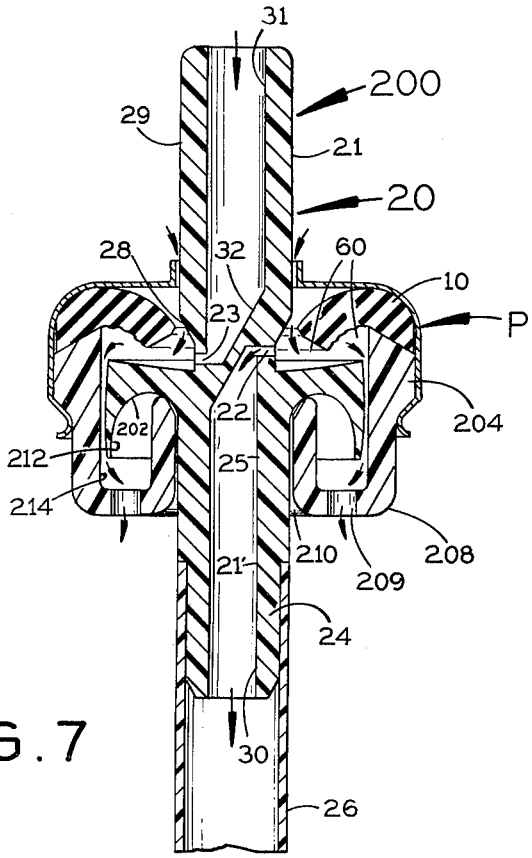
FIG. 7 is another view similar to FIG. 5 and shows the valve of that Figure as it operates when a container is being filled.

FIG. 7 shows the valve 200 operating in a filling mode. The valve body 20 has been depressed. Product flows under high pressure from a filling source both inside and outside the valve stem 21 into the compartment 60. Some product flows through orifice 22 and education passage 30 into a container. Other product flows around the outside of piston 202 and through apertures 209 into the container.

The valve 200 has all of the advantages and performs all of the functions of the valve 1 of FIG. 1. In addition, the valve 200 has another advantage in that the piston 202, since it slides down when depressed, forms a considerably larger compartment 60 than does the diaphragm 50 of FIG. 1. The larger compartment induces greater expansion and turbulence of the mixture emerging from orifice 22, thus providing a more uniform particle size in the aerosol which is discharged from the valve. Uniformity in particle size is important in producing a more uniform spraying pattern and product application as well as a longer period of suspension in the atmosphere. Another advantage of the valve 200 is that it permits the filling of a container around the stem as well as through the stem as described and illustrated in connection with FIG. 7.

Figure 8:
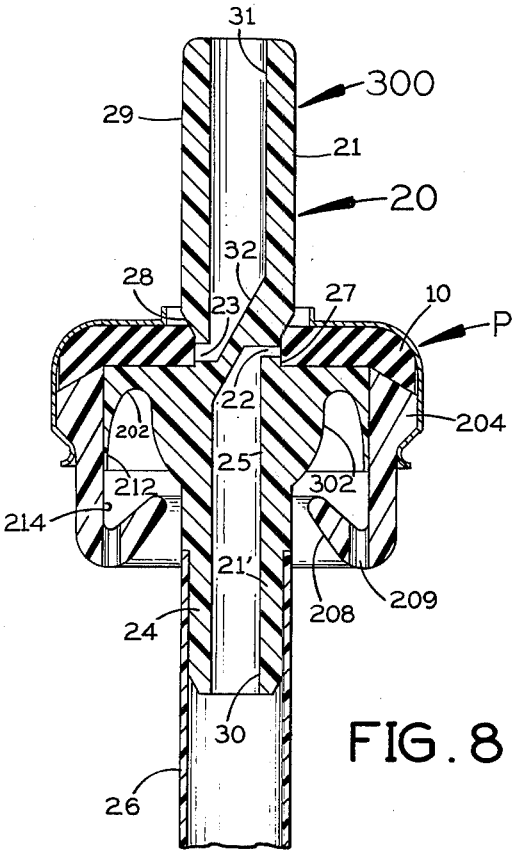
FIG. 8 is a side elevation view, in vertical section, of a modification of the valve of FIG. 5.

FIG. 8 illustrates a valve 300 which is a modification of the valve 200 of FIG. 5. The same reference numerals are used for like parts in these two Figures, and only the differences will be described. The lower part 21' of the valve stem 21 has an inverted semi-spherical surface 302. The guide portion 208 of mounting ring 204 slants toward the surface 302 but stops short of it so that the valve stem 21 can be tilted. The axes of the orifices 22 and 23 are aligned and in a common plane. However, the bottom of inlet orifice 22 is spaced vertically above the bottom of the outlet orifice 23 so that the inlet orifice will still close before the outlet orifice 22 in the closing movement of the valve. Thus, the valve 300 depends on sequential closing of the inlet and outlet orifices in its operation, and the inlet orifice is spaced vertically above at least part of the outlet orifice to provide the purging action described heretofore.

Figure 9:
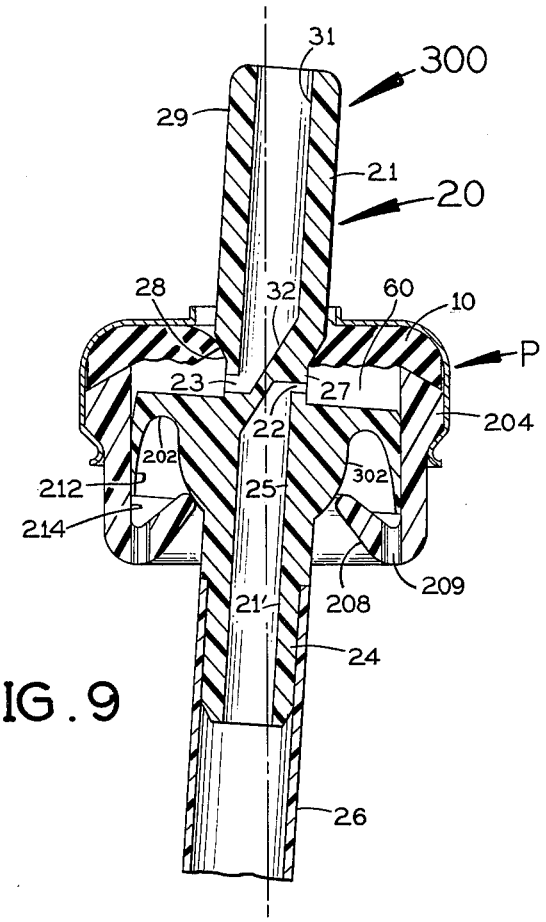
FIG. 9 is a view similar to FIG. 8 and showing the valve of that Figure tilted to discharge product.

FIG. 9 shows the valve 300 depressed and tilted to dispense product. The valve 300 has all of the advantages and functions of the valve 200 of FIG. 5 and represents a modification thereof.

Figure 10:
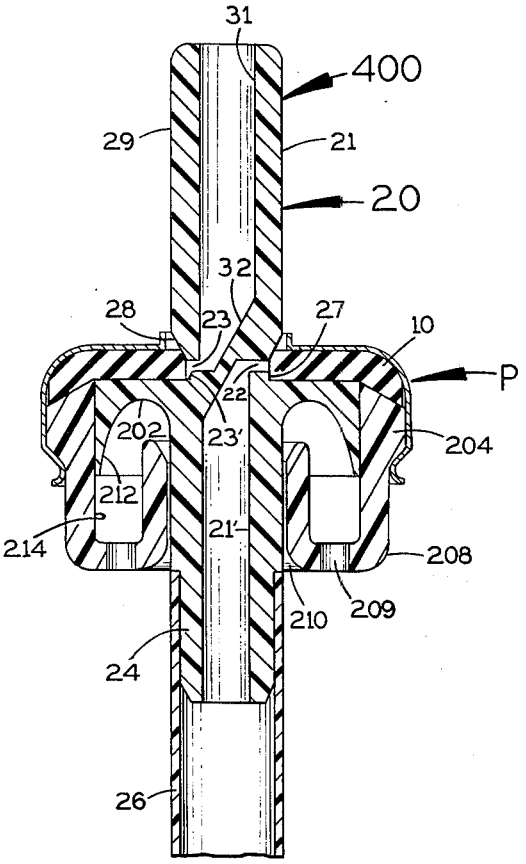
FIG. 10 is a side elevation view, in vertical section, of another modification of the valve of FIG. 5.
Figure 11:
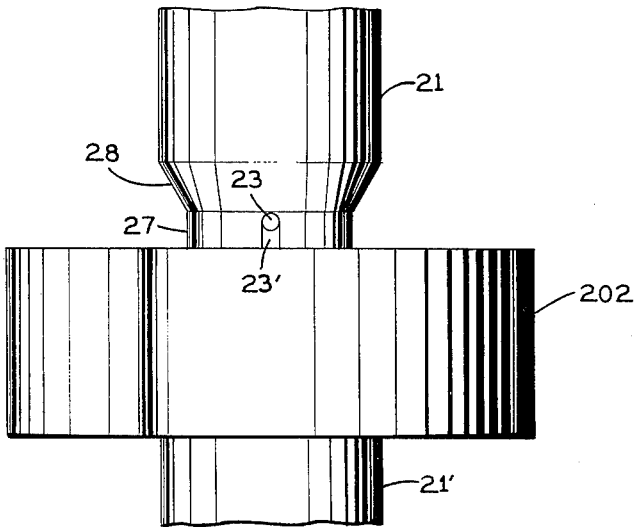
FIG. 11 is a side elevation view of a portion of the valve of FIG. 10.

FIG. 10 and 11 show a valve 400 which is also a modification of the valve 200 of FIG. 5. The same reference numerals are used for like parts in these two Figures. The only difference between FIGS. 5 and 10 is that in FIG. 5, the axes of the orifices 22 and 23 are offset vertically in a common plane, whereas in FIG. 10, the axes of the orifices 22 and 23 are aligned in a common plane. However, in FIG. 10, outlet orifice 23 has a downwardly offset portion 23' which is below the bottom of inlet orifice 22. Thus, the inlet orifice is still vertically spaced above at least part of the outlet orifice, and the inlet orifice closes before the outlet orifice in the closing movement of the valve to provide the purging action described heretofore. The valve 400 has all of the advantages and functions of the valve 200 of FIG. 5.

I claim:

1. In a valve for use with a pressurized aerosol dispensing container containing pressurized product which valve comprises:

hollow annular mounting means for sealed attachment to the mouth of the container and having an inside cylindrical surface;

an axially movable, tubular valve body spaced inward from said cylindrical surface, which valve body includes a longitudinal bore therethrough with a wall having vertically offset portions and separating the bore into an eduction passageway below said wall and a discharge passageway above said wall, an inlet orifice below said wall and formed in said valve body in communication with said eduction passageway, an outlet orifice above said wall and formed in said valve body in communication with said discharge passageway, and said orifices having bottoms with the bottom of said outlet orifice below the bottom of said inlet orifice; and an annular elastomeric sealing gasket encompassing said valve body with its inner margin normally sealingly occluding both of said orifices to close said valve and overlying said annular mounting means, said gasket having an underside;

the separation between the bottoms of said inlet and outlet orifices providing occlusion of the inlet orifice before the outlet orifice by said gasket as the valve moves toward closure;

the improvement wherein:

said valve body has a circular, yieldable piston affixed thereto normally engaging the underside of said gasket and slidably and sealingly engaging the inside cylindrical surface of said annular mounting means so that when said valve body is depressed, said gasket flexes downward to open said orifices and said piston slides down along said inside cylindrical surface of said annular mounting means to form an annular chamber which communicates said inlet orifice with said outlet orifice.

2. The valve as claimed in claim 1 in which said piston has an annular depending side wall having an inside and slidably engaging the inside cylindrical surface of said annular mounting means and yieldable to disengage from the latter under the pressure of pressurized product introduced into the valve from above for allowing filling of a container by depression of said valve body and flow of product by a path between said gasket and said valve body and between said side wall of the piston and said inside cylindrical surface of said annular mounting means as well as by a path through said passageways and said orifices.

3. A valve according to claim 2, wherein said annular mounting means comprises a mounting ring formed with a bore which slidably receives said piston, said mounting ring having an inwardly extending portion at the bottom of said ring with bottom openings therein for exposing the bottom and the inside of said piston to the pressure in the container below.

4. A valve according to claim 3, wherein said mounting ring has a central, annular guide and stop portion standing up from said inwardly extending portion and defining an inner bore which is concentrically disposed inside said first-mentioned bore in the mounting ring and which slidably receives and guides said valve body and acts as a stop for the same.

5. A valve according to claim 3, wherein:

said mounting ring has an inwardly and upwardly protruding guide portion at the bottom;

and said valve body has a tapered segment facing toward said guide portion for engagement with the latter when the valve body is depressed and tilted.

6. In a valve for use with a pressurized aerosol dispensing container having a mouth and containing pressurized product, said valve having:

hollow annular mounting means for sealed attachment to the mouth of the container and having a cylindrical inside surface;

a tubular valve body extending down through said mounting means and axially displaceable therein between a normal upper position and a downwardly-displaced lower position, said valve body having a longitudinal bore therethrough and an interior wall having vertically offset portions and blocking the bore and dividing it longitudinally into an eduction passageway below said wall and a discharge passageway above said wall, said valve body having a transverse inlet orifice opening directly into the upper end of said eduction passageway below said wall and a transverse outlet orifice opening directly into the lower end of said discharge passageway above said wall, said inlet orifice being above at least part of said outlet orifice, said orifices having bottoms with the bottom of said outlet orifice below the bottom of said inlet orifice, said valve body having a circumferential, downwardly facing tapered surface closely above said inlet and outlet orifices;

an annular, elastomeric, sealing gasket overlapping said mounting means and extending circumferentially around said valve body transverse to the latter, said gasket having an annular inside edge which defines a central opening therein which snugly receives said valve body and sealingly engages the valve body around said inlet and outlet orifices in said normal position of the valve body, with said downwardly facing surface on the valve body sealingly engaging the gasket around the top of said central opening in the latter and serving to flex said gasket downwardly when said valve body is depressed to open said orifices;

and an annular transverse wall attached to said valve body and extending transversely outward therefrom directly below and normally engaging said gasket;

the improvement wherein;

said transverse wall is the upper, yieldable end of a reciprocable piston having an annular, yieldable side wall extending circumferentially down from said transverse wall and sealingly engaging the cylindrical inside surface of said annular mounting means and slidable up and down along the latter, said transverse wall having a bottom and said side wall having an inside;

and means exposing the bottom of said transverse wall and the inside of said annular side wall of the piston to the pressure in the container below to bias said piston upwardly and to maintain said annular side wall in sealing engagement with the inside of said annular mounting means.

7. A valve according to claim 6, wherein said annular side wall of the piston is deformable by the pressure of pressurized product introduced into the valve from above to disengage from the cylindrical inside surface of said annular mounting means and thereby enable the pressurized product to pass between said inside surface and said side wall down into the container below for filling the same.

8. A valve according to claim 7, wherein said annular mounting means comprises a mounting ring formed with a bore which slidably receives said piston, said mounting ring having an inwardly extending portion at the bottom of said ring with bottom opening therein for exposing the bottom and the inside of said piston to the pressure in the container below.

9. A valve according to claim 8, wherein said mounting ring has a central, annular, guide portion standing up from said inwardly extending portion and defining an inner bore which is concentrically disposed inside said first-mentioned bore in the mounting ring and which slidably receives and guides said valve body and acts as a stop for the same.

10. A valve according to claim 9, wherein:

said mounting ring has an inwardly and upwardly protruding guide portion at the bottom;

and said valve body has an inverted semispherical segment facing toward said guide portion for engagement with the latter to stop said body when the valve body is tilted.

* * * * *